US009061524B2

(12) United States Patent
Matsuo

(10) Patent No.: US 9,061,524 B2
(45) Date of Patent: Jun. 23, 2015

(54) PAPER PROCESSING DEVICE WITH STANDBY POSITION AND IMAGE FORMING APPARATUS WITH THE SAME

(71) Applicant: KYOCERA Document Solutions Inc., Osaka (JP)

(72) Inventor: Takeshi Matsuo, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 89 days.

(21) Appl. No.: 13/951,266

(22) Filed: Jul. 25, 2013

(65) Prior Publication Data

US 2014/0054837 A1 Feb. 27, 2014

(30) Foreign Application Priority Data

Aug. 23, 2012 (JP) ..... 2012-183839

(51) Int. Cl.

| | |
|---|---|
| ***B65H 37/04*** | (2006.01) |
| ***B41J 13/00*** | (2006.01) |
| ***G03G 15/00*** | (2006.01) |
| ***B42B 4/00*** | (2006.01) |
| ***B42C 1/12*** | (2006.01) |

(52) U.S. Cl.

CPC ..... *B41J 13/0009* (2013.01); *G03G 15/6541* (2013.01); *G03G 2215/00827* (2013.01); *B42B 4/00* (2013.01); *B42C 1/125* (2013.01)

(58) Field of Classification Search

CPC ..... B65H 37/04
USPC ..... 270/58.08, 58.11, 58.12; 399/410
See application file for complete search history.

(56) References Cited

U.S. PATENT DOCUMENTS

| | | | | |
|---|---|---|---|---|
| 5,072,920 | A * | 12/1991 | Kubota et al. | 270/58.11 |
| 5,083,760 | A * | 1/1992 | Yamazaki et al. | 270/58.11 |
| 5,639,078 | A | 6/1997 | Mandel et al. | |
| 5,735,515 | A * | 4/1998 | Hayashi et al. | 270/58.11 |

(Continued)

FOREIGN PATENT DOCUMENTS

| | | | |
|---|---|---|---|
| JP | 09-188470 | A | 7/1997 |
| JP | 2007-314332 | A | 12/2007 |

(Continued)

OTHER PUBLICATIONS

Notice of Rejection mailed by Japan Patent Office on Sep. 24, 2014 in the corresponding Japanese patent application No. 2012-183839—5 pages.

*Primary Examiner* — Patrick Mackey
(74) *Attorney, Agent, or Firm* — Knobbe, Martens, Olson & Bear LLP

(57) ABSTRACT

A paper processing apparatus includes a tray, a conveying section, a catching member, a paper processing section, a moving mechanism, and a control section. The catching member includes an abutting surface which abuts a top part of paper in a conveying direction of the paper and a covering part which covers one of one surface and the other surface of the paper, and is disposed at a downstream side in the paper conveying direction. The control section controls the moving mechanism to move a paper processing section between a standby position at which the catching member is received in a processing region and a processing position at which the paper is received in the processing region. The control unit controls the conveying section to convey the paper to the tray in a state in which the moving mechanism positions the paper processing unit at the standby position.

8 Claims, 7 Drawing Sheets

(56) References Cited

U.S. PATENT DOCUMENTS

| | | | | |
|---|---|---|---|---|
| 6,164,511 | A * | 12/2000 | Chung et al. | 227/148 |
| 7,207,556 | B2 * | 4/2007 | Saitoh et al. | 270/58.08 |
| 7,862,023 | B2 * | 1/2011 | Ichihashi et al. | 270/58.09 |
| 8,794,617 | B2 * | 8/2014 | Tokuma | 270/58.12 |
| 8,905,394 | B2 * | 12/2014 | Miyake et al. | 270/58.11 |
| 2007/0035082 | A1 * | 2/2007 | Kushida | 270/58.12 |
| 2007/0096381 | A1 * | 5/2007 | Nishioka | 270/58.12 |
| 2012/0153556 | A1 * | 6/2012 | Sugiyama et al. | 270/58.08 |
| 2013/0270763 | A1 * | 10/2013 | Furuhashi et al. | 270/58.08 |
| 2013/0313771 | A1 * | 11/2013 | Okumura | 270/58.08 |

FOREIGN PATENT DOCUMENTS

| | | | |
|---|---|---|---|
| JP | 2007314332 | A * | 12/2007 |
| JP | 2009-242014 | A | 10/2009 |

* cited by examiner

PAPER PROCESSING DEVICE WITH STANDBY POSITION AND IMAGE FORMING APPARATUS WITH THE SAME

INCORPORATION BY REFERENCE

This application claims priority to Japanese Patent Application No. 2012-183839 filed on Aug. 23, 2012, the entire contents of which are incorporated by reference herein.

BACKGROUND

The present disclosure relates to a paper processing apparatus for performing paper processing on paper and an image forming apparatus including the paper processing apparatus.

An image processing apparatus includes a paper processing apparatus for performing stapling on a bundle of papers on which images are formed. In the paper processing apparatus, a stapler needs to insert a staple inward than an end of a bundle of papers. Therefore, protruding members which protrude toward an inner side of the bundle of papers from the end of the bundle of papers are each disposed at both sides of the bundle of papers. Further, paper is positioned so that an end of paper conveyed from the image forming apparatus to the paper processing apparatus is inserted between the two protruding members of the stapler.

Herein, when a tip of the paper conveyed from the image forming apparatus to the paper processing apparatus enters a space sandwiched between the two protruding members of the stapler, the paper may interfere with the protruding member. Therefore, a technique of providing a film member smoothly guiding the paper into a back side of the stapler has been known.

SUMMARY

As an aspect of the present disclosure, a technique of further improving the above-mentioned related art has proposed.

According to an aspect of the present disclosure, a paper processing apparatus includes a tray, a conveying section, a catching member, a paper processing section, a moving mechanism, and a control section.

The tray has a load surface on which paper is loaded and stored.

The conveying section conveys the paper to the tray.

The catching member includes an abutting surface which abuts a tip part of the paper in a conveying direction of the paper conveyed by the conveying section and disposed on the load surface and a covering part which is disposed on the abutting surface to cover at least one of one surface and the other surface of the paper in a state in which the tip part abuts the abutting surface, wherein the abutting surface and the covering part are disposed in a partial region in a paper width direction orthogonal to the conveying direction at a position downstream in the conveying direction in the tray.

The paper processing section includes a processing region which receives the tip part of the paper in the abutting state to perform a predetermined paper process on the tip part.

The moving mechanism moves the paper processing section in a width direction of the paper.

The control section controls the moving mechanism to move the paper processing section between a standby position at which the catching member is received in the processing region and a processing position at which the tip part of the paper is received in the processing region without passing through the catching member.

Further, the control section controls the conveying section to convey the paper to the tray in a state in which the moving mechanism positions the paper processing section at the standby position.

DETAILED DESCRIPTION

Figure 1:
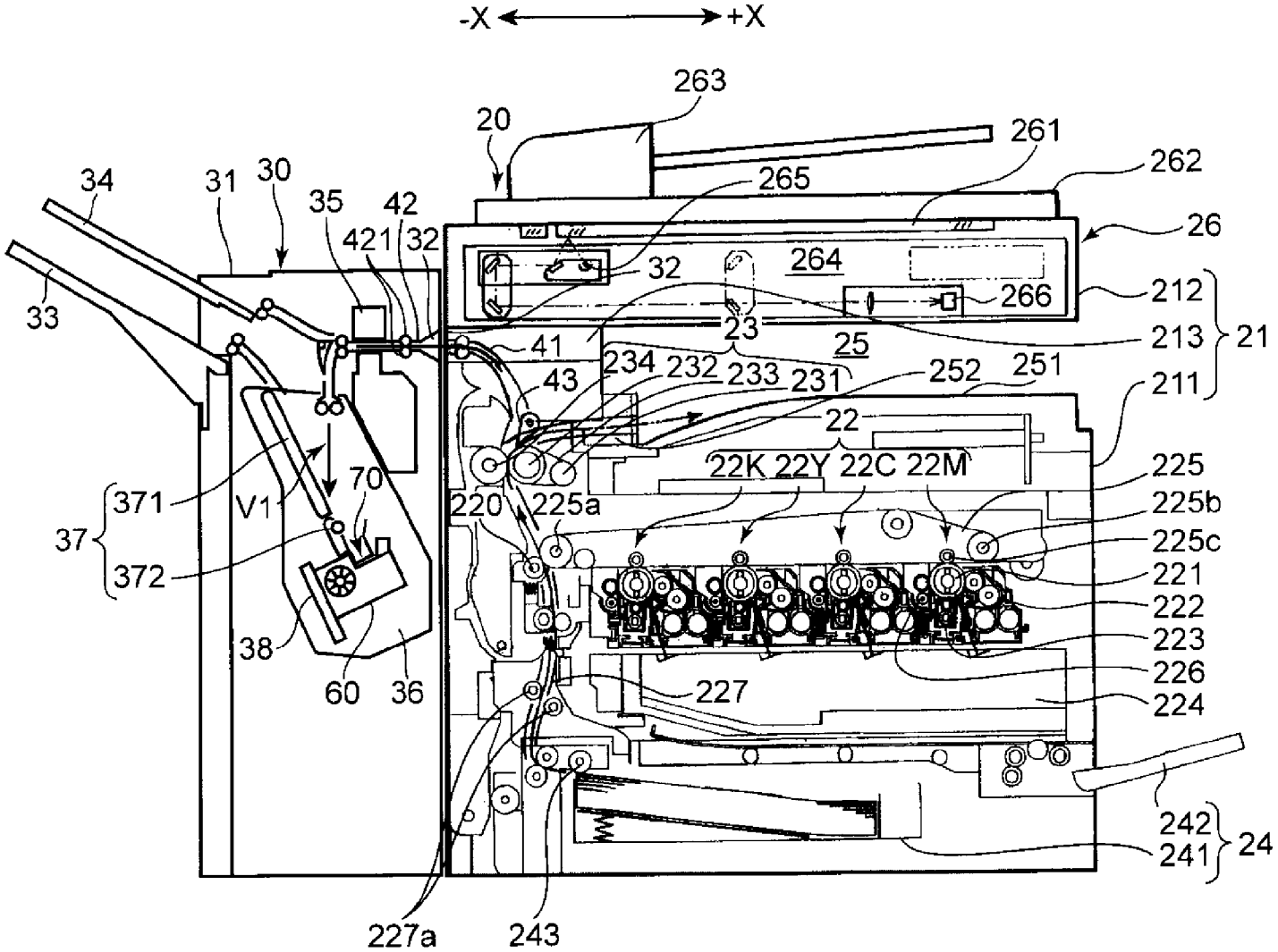
FIG. 1 is a front cross-sectional view for describing an embodiment of an inner structure of an image forming apparatus including a paper processing apparatus according to an embodiment of the present disclosure.

Hereinafter, embodiments of the present disclosure will be described with reference to the drawings. Meanwhile, in each diagram, like reference numerals are assigned to like components and thus its description will be omitted.

FIG. 1 is a front cross-sectional view for describing an embodiment of an inner structure of an image forming apparatus including a paper processing apparatus according to an embodiment of the present disclosure. Meanwhile, in FIG. 1, an X-X direction refers to a left-to-right direction and a direction orthogonal to a paper surface refers to a back-to-front direction, in particular, a −X direction refers to a left side, a +X direction refers to a right side, a direction toward an upper surface of the figure refers to a front side and a downward direction with respect to the surface of the figure refers to a back side.

As illustrated in FIG. 1, an image forming apparatus 10 includes an apparatus main body section 20 which performs image forming processes on paper P and a paper processing apparatus 30 configured to define a processing position of the paper P subjected to the image forming processes and onto which a toner image is transferred by the apparatus main body section 20 and perform predetermined post-processing.

The apparatus main body section 20 is a copying machine which reads a document image and copies the same image as the document image. The overall appearance of the apparatus main body section 20 is a box-shaped main body section casing 21. The main body section casing 21 includes an image forming section 22, a fixing section 23, a paper storage section 24, a paper ejection section 25, and an image reading section 26. Further, the paper ejection section 25 is formed by recessing a portion of the main body section casing 21 from a lower portion of the image reading section 26. Thus, the apparatus body section 20 is referred to as an intra-barrel paper ejection type.

The main body section casing 21 includes a rectangular parallelepiped shaped lower casing 211, a flat rectangular parallelepiped shaped upper casing 212 disposed opposite thereto, above the lower casing 211, and a connector 213 disposed between the upper casing 212 and the lower casing 211. The connector 213 is a structure for connecting the lower casing 211 and the upper casing 212 in a state in which the paper ejection section 25 is formed between the lower casing 211 and the upper casing 212. The connector 213 is upright from the left portion of the lower casing 211. The left portion of the upper casing 212 is supported by an upper end portion of the connector 213.

Further, the lower casing 211 has the image forming section 22, the fixing section 23, and the paper storage section 24 embedded therein. The upper casing 212 includes the image reading section 26 mounted therein. Further, the upper casing 212 includes an operating section (not illustrated) which protrudes forward on a front surface thereof to perform various kinds of input operations.

The paper ejection section 25 is formed between the lower casing 211 and the upper casing 212. The paper ejection section 25 has an intra-barrel ejection paper tray 251 which is formed on an upper surface of the lower casing 211. The paper P onto which a toner image is transferred by the image forming section 22 is ejected toward the intra-barrel ejection paper tray 251 from a lower portion of a connector 213 through the fixing section 23.

The image forming section 22 forms the toner image on the paper P fed from the paper storage section 24 and includes a magenta unit 22M, a cyan unit 22C, a yellow unit 22Y, and a black unit 22K which are sequentially arranged toward a downstream side from an upstream side (a right side).

Each of the units 22M, 22C, 22Y, and 22K includes a photosensitive drum 221 and a developing device 222. In FIG. 1, each photosensitive drum 221 is supplied with toner from the corresponding developing devices 222 by being rotated counterclockwise. Each developing device 222 is supplied with toner from a toner cartridge (not illustrated) which is arranged at a front side (an upper side of surface of FIG. 1) of the main body section casing 21.

Charging devices 223 are disposed just under each photosensitive drum 221. Exposing devices 224 are disposed under each charging device 223. Peripheral surfaces of each photosensitive drum 221 are uniformly charged by the charging devices 223. Further, laser lights corresponding to each color based on the image data read by the image reading section 26 are radiated to the charged peripheral surfaces of the photosensitive drums 221 from each exposing device 224, thereby forming an electrostatic latent image on the peripheral surfaces of each photosensitive drum 221. A toner image is formed on the peripheral surface of the photosensitive drum 221 by supplying toner to the electrostatic latent image from the developing device 222.

A transfer belt 225 which is stretched between a driving roller 225*a* and a driven roller 225*b* is disposed above the photosensitive drum 221 so as to abut each photosensitive drum 221.

The transfer belt 225 travels around between the driving roller 225*a* and the driven roller 225*b* in synchronization with each photosensitive drum 221 while facing the peripheral surface of the photosensitive drum 221 by drum transfer rollers 225*c* disposed to correspond to each photosensitive drum 221.

Therefore, when the transfer belt 225 travels around, a toner image of magenta is transferred onto the surface thereof by the photosensitive drum 221 of the magenta unit 22M, a toner image of cyan is transferred to the same position of the transfer belt 225 by the photosensitive drum 221 of the cyan unit 22C in an over-spraying state, a toner image of yellow is transferred to the same position of the transfer belt 225 by the photosensitive drum 221 of the yellow unit 22Y in an over-spraying state, and finally a toner image of black is transferred by the photosensitive drum 221 of black unit 22K in an over-spraying state.

Thus, color images are formed on the surface of the transfer belt 225. The color images formed on the surface of the transfer belt 225 are transferred onto the paper P conveyed from the paper storage section 24.

Further, in FIG. 1, cleaning devices 226 which clean the peripheral surfaces of each photosensitive drum 221 by removing the residual toner on the peripheral surfaces of each photosensitive drum 221 are disposed at right positions of each photosensitive drum 221. The peripheral surface of the photosensitive drum 221 cleaned by the cleaning devices 226 faces the charging device 223 to perform a new charging process.

Waste toner removed from the peripheral surface of the photosensitive drum 221 by the cleaning devices 226 is recovered to a waste toner bottle (not illustrated) through a predetermined path.

A vertically extending vertical conveying path 227 is disposed at the left of the image forming section 22. A pair of conveying rollers 227*a* are disposed at an appropriate place in the vertical conveying path 227 and the paper P from the paper storage section 24 is conveyed toward the transfer belt 225 by the pair of conveying rollers 227*a*.

A secondary transfer roller 220 having a peripheral surface facing the surface of the transfer belt 225 at a position facing the driving roller 225*a* is disposed in the vertical conveying path 227. The paper P conveyed through the vertical conveying path 227 is sandwiched between the transfer belt 225 and the secondary transfer roller 220 by pressing, such that the toner image on the transfer belt 225 is transferred onto the paper P.

The fixing section 23 performs a fixing process on the toner image on the paper P transferred in the image forming section 22. The fixing section 23 includes a heating roller 231 having an electric heat generating body such as a halogen lamp, which is a heating source, embedded therein, a fixing roller 232 disposed to face the heating roller 231 at the left, a fixing belt 233 rotating between the fixing roller 232 and the heating roller 231, and a pressing roller 234 disposed to face the fixing belt 233 at the left.

Further, the toner image is fixed onto the transferred paper P derived from the image forming section 22 through the secondary transfer roller 220 by the heating process of the fixing belt 233 while the paper P is sandwiched between the fixing roller 232 and the pressing roller 234 through the fixing belt 233 by pressing, thereby forming the color image in a stabilized state on the paper P. The color printed paper P which has been subjected to the fixing process is ejected toward the intra-barrel ejection paper tray 251 through a conveying path 252 for the intra-barrel ejection paper tray extending from above the fixing section 23.

The paper storage section 24 includes a paper feeding tray 241 which is insertably and removably disposed at a position under the exposing device 224 in the main body section casing 21 and a manual feed tray 242 which is disposed to open and close freely to the right side of the lower casing 211. The paper feeding tray 241 stores a bundle of paper. Further, the paper P is fed out sheet by sheet from the bundle of paper stored in the paper feeding tray 241 by driving a pick up roller 243 and then is introduced into the image forming section 22 through the vertical conveying path 227.

The manual feed tray 242 is a tray for manually feeding the paper P sheet by sheet. The paper P fed from the manual feed tray 242 is fed to the image forming section 22 through a bypass conveying path disposed at a position above the paper feeding tray 241.

The image reading section 26 includes a contact glass 261 which is mounted on a top opening of the upper casing 212 to load a document, facing a document surface downwardly, a flat rectangular parallelepiped document pressing member 262 which is formed to open and close freely on the contact glass 261 to press the document loaded on the contact glass 261, a document automatic reading apparatus 263 which is disposed on the document pressing member 262, and an optical unit 264 which reads a document image of a document loaded on the contact glass 261 or sent onto the contact glass 261 from the document automatic reading apparatus 263.

The optical unit 264 reads the image loaded on the contact glass 261 or the fed document image with reflected light by light irradiation from a light source 265. The reflected light is input to a charge coupled device (CCD) 266 disposed in the image reading section 26 and is digitalized and then output toward the exposing device 224 of the image forming section 22.

A conveying path 41 for a post-processing section branched from the vertical conveying path 227 at a downstream side from the fixing section 23 is disposed in the connector 213. A downstream end of the conveying path 41 for a post-processing section faces an upstream end of an inlet side conveying path 42 disposed at the paper processing apparatus 30, that is, a paper receiving opening 32. A connection conveying path 40 is formed by the conveying path 41 for a post-processing section and the inlet side conveying path 42.

A paper discharge destination switching guide 43 is disposed at a branched position of the conveying path 41 for a post-processing section and the conveying path 252 for the intra-barrel ejection paper tray at the downstream end of the vertical conveying path 227. Further, the paper P derived from the fixing section 23 is ejected to the intra-barrel ejection paper tray 251 through the conveying path 252 for the intra-barrel paper tray by changing the position of the paper discharge destination switching guide 43, or introduced into the paper processing apparatus 30 unit through the conveying path 41 for a post-processing section.

The apparatus main body section 20 includes a main body control section configured of a microcomputer, for example. The main body control section controls an operation of each section within the apparatus main body section 20.

Figure 2:
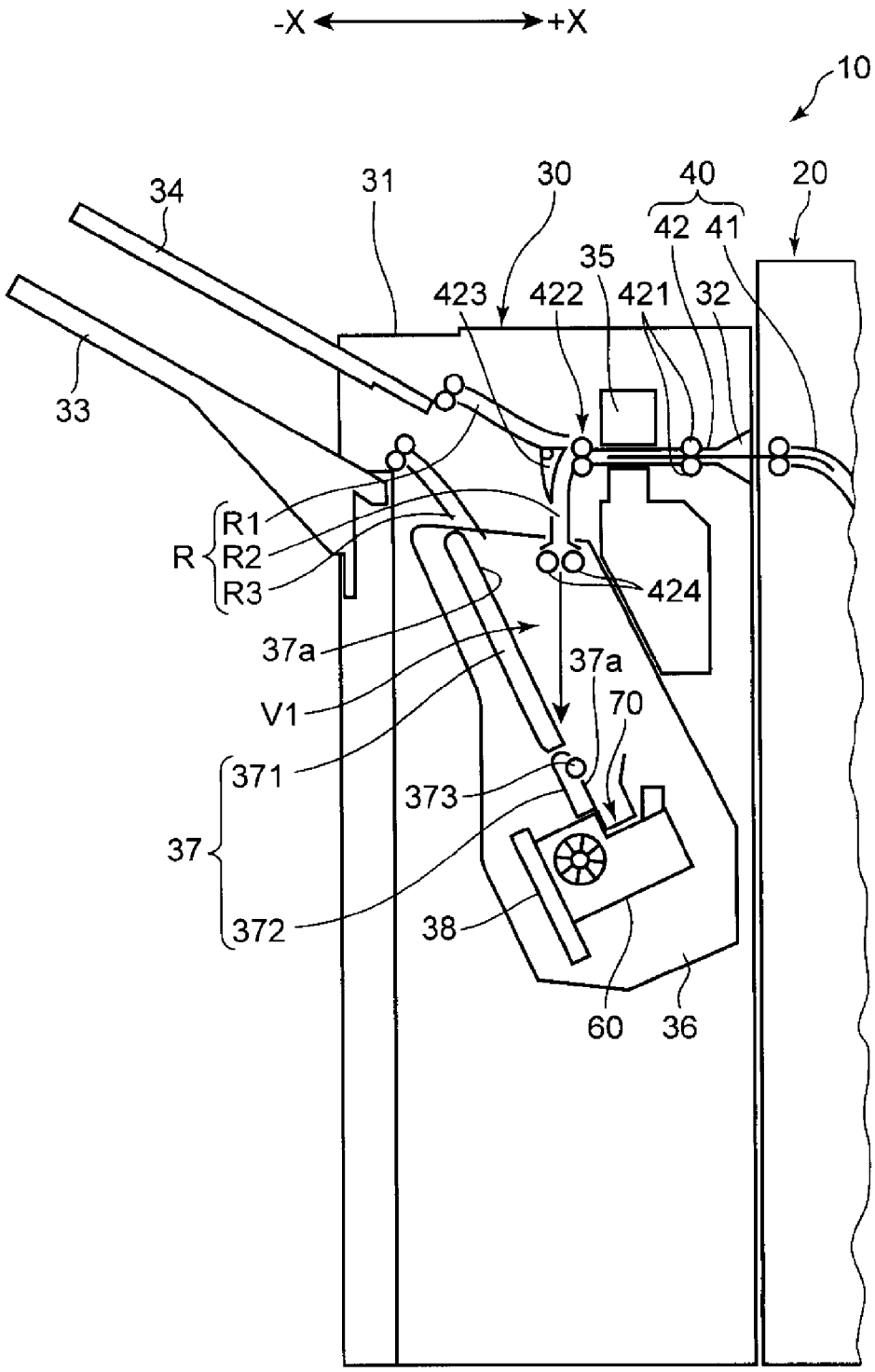
FIG. 2 is a diagram for describing an example of a configuration of the paper processing apparatus illustrated in FIG. 1.

Next, the paper processing apparatus 30 according to the present embodiment will be described with reference to FIG. 2. FIG. 2 is an enlarged view of the paper processing apparatus 30 illustrated in FIG. 1. Meanwhile, a direction indication by X in FIG. 2 is the same as in the case of FIG. 1 (−X: left, +X: right). As illustrated in FIG. 2, the paper processing apparatus 30 is configured to perform the predetermined post-processing on the paper P sent from the apparatus main body section 20 and includes a post-processing member to be described later which is embedded in a box-shaped post-processing unit housing 31.

A pair of receiving rollers 421 receiving the paper P from the paper receiving opening 32 are disposed at the upstream end of the inlet side conveying path 42. A pair of dispensing rollers 422 which dispense the paper P to a paper conveying path R disposed on a downstream side are disposed at the downstream end of the inlet side conveying path 42.

The paper processing apparatus 30 includes a plurality of paper conveying paths R formed by branching from the inlet side conveying path 42 to convey the paper P conveyed from the apparatus main body section 20 to each position according to the purpose.

The paper conveying path R includes a conveying path R1 for a sub tray which branches from a downstream side of the pair of dispensing rollers 422 to extend toward a sub tray 34, a staple tray conveying path R2 which branches from a downstream side of the pair of dispensing rollers 422 and conveys the paper P toward a staple tray 37 to be described later, and a conveying path R3 for a main tray extending to a main tray 33 from above the staple tray 37.

A punch unit 35 is disposed at the inlet side conveying path 42. Further, an appropriate place of the paper P introduced into the inlet side conveying path 42 through the paper receiving opening 32 is perforated with a binding hole through a punching process by driving the punch unit 35 while the paper is temporarily stopped.

A pair of first frame plates 36 which is disposed in a back and forth direction (a direction orthogonal to a paper surface of FIG. 2) is disposed under the inlet side conveying path 42. The staple tray 37 (a tray) of which the front end is inclined downward and to the right is arranged between the pair of first frame plates 36. The staple tray 37 includes a storage space V1 which is formed on an upper surface 37*a* (a load surface) thereof to store the paper P.

A stapler 60 which performs a stapling process on the bundle of papers P stored in the storage space V1 is disposed under (downstream in a conveying direction from) the staple tray 37.

A stapler base 38 (a moving mechanism) which slidably holds the stapler 60 in a width direction orthogonal to the paper conveying direction is installed between the pair of first frame plates 36 at a lower portion of the staple tray 37.

A switching guide 423 switching the destination of the paper P between the conveying path R1 for a sub tray and the staple tray conveying path R2 is disposed at a downstream end of the inlet side conveying path 42. When the staple process is not performed on the paper P, the paper P is discharged to the sub tray 34 through the conveying path R1 for a sub tray by the predetermined position setting of the switching guide 423. Meanwhile, when the stapling process is performed on the paper P, the paper P is sent to the staple tray conveying path R2 by changing the position of the switching guide 423.

A pair of introduction rollers 424 (a conveying section) which convey the paper P to the staple tray 37 are disposed at the downstream end of the staple tray conveying path R2. When a predetermined number of sheets of paper P are conveyed onto the staple tray 37 by the pair of introduction rollers 424, a plurality of sheets of paper P are stored in the storage space V1 and a bundle of paper is formed in the storage space V1. Thus, after the bundle of paper is formed in the storage space V1, the stapling process is performed on the bundle of paper by the stapler 60.

The staple tray 37 includes an upper tray 371 and a lower tray 372. The lower tray 372 is disposed at the lower portion (downstream side in a conveying direction) of the upper tray 371 to continue to the upper tray 371.

Figure 3:
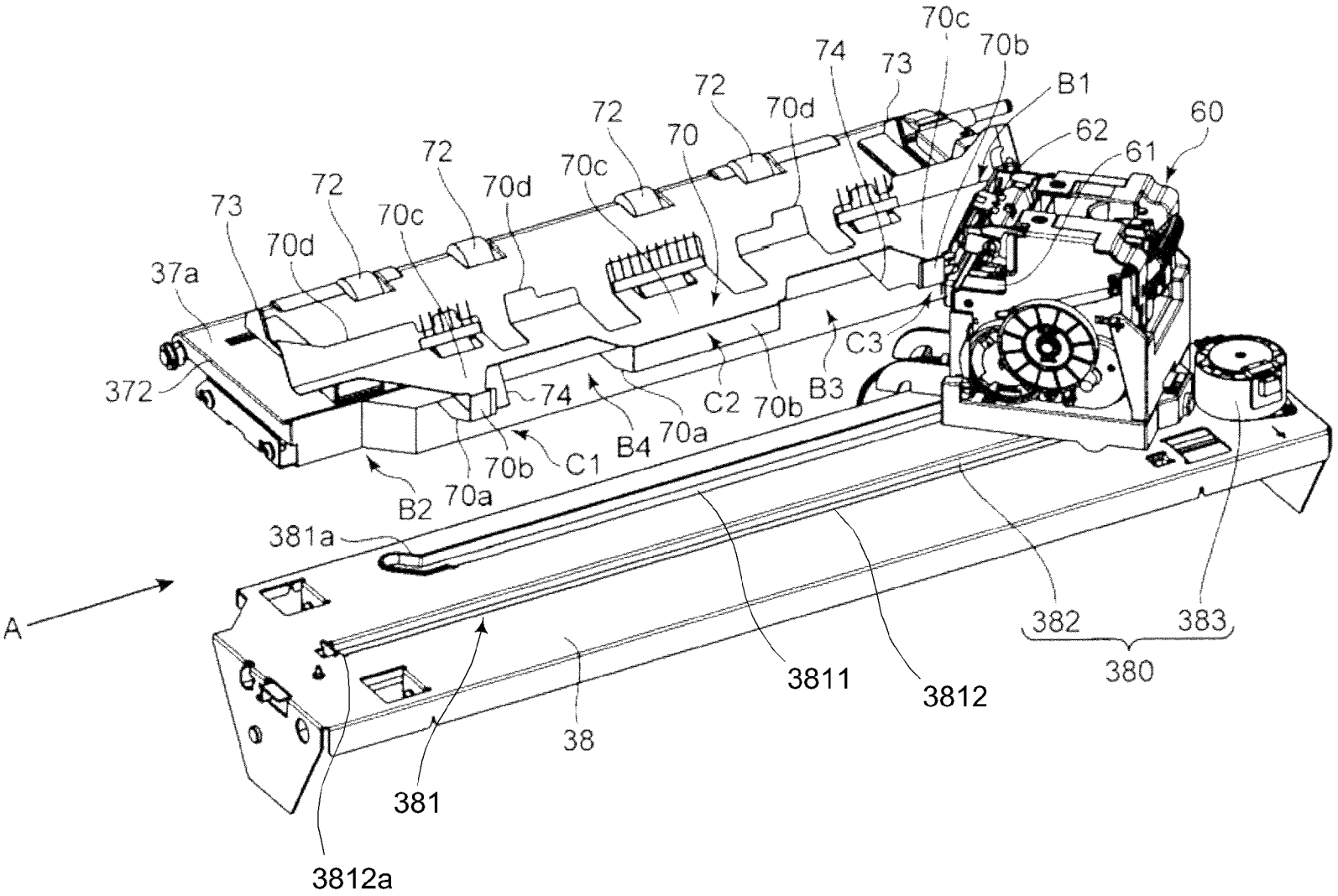
FIG. 3 is a perspective view illustrating in detail a configuration of a lower tray and a stapler.
Figure 4:
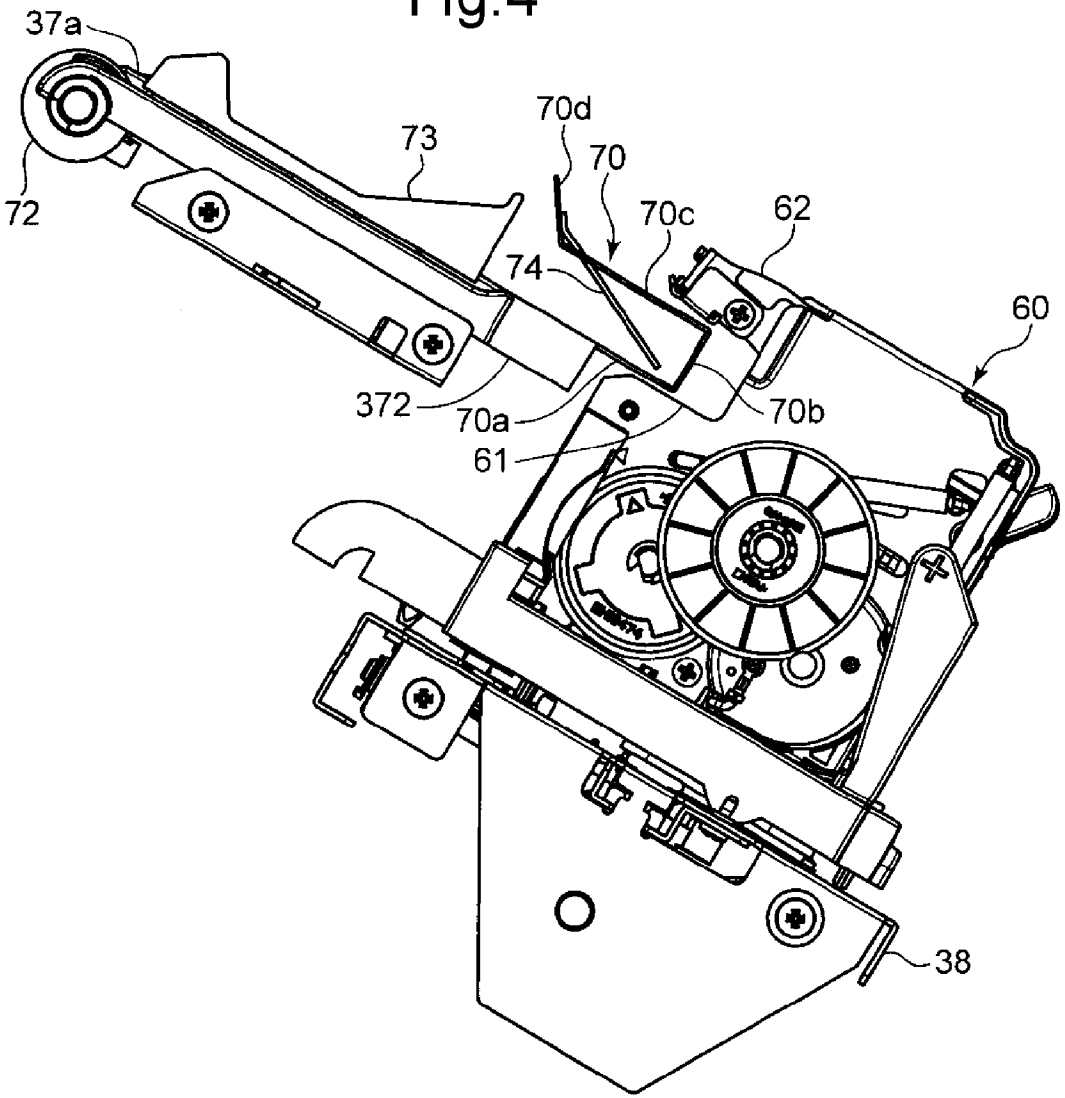
FIG. 4 is a side view of the lower tray and the stapler illustrated in FIG. 3.

FIG. 3 is a perspective view illustrating in detail a configuration of the lower tray 372 and the stapler 60. FIG. 4 is a side view of the lower tray 372 and the stapler 60 illustrated in FIG. 3, which is viewed from a direction of an arrow A of FIG. 3.

A catching member 70 receiving the paper P conveyed from the upstream side of the lower tray 372 is connected to a downstream side end portion of the lower tray 372 in the paper conveying direction. The catching member 70 is formed by bending, for example, a metal plate in a U-shape.

The catching member 70 is disposed in a portion of a region in the paper width direction orthogonal to the paper conveying direction.

The catching member 70 includes a first wall (a covering part, a first covering part) 70*a*, a reference wall (an abutting surface) 70*b*, and an end portion of the second wall (a covering part, a second covering part) 70*c*. The first wall 70*a* extends downstream in the paper conveying direction from the upper surface 37*a* of the lower tray 372. The reference wall 70*b* is upright in an upper surface direction of the lower tray 372 from a downstream side end portion of the first wall 70*a* in the paper conveying direction. The second wall 70*c* extends upstream in the paper conveying direction from an end portion of the reference wall 70*b* on the upper surface direction side of the lower tray 372. Further, the catching member 70 is provided with a reception wall 70*d* which obliquely protrudes upstream in the paper conveying direction from an end portion of the second wall 70*c* on the upstream side in the paper conveying direction and in a direction which becomes the surface direction side of the lower tray 372. A surface of the reference wall 70*b* on the upstream side in the paper conveying direction becomes an abutting surface of the paper. Further, the first wall 70*a* extends upstream in the paper conveying direction from one end of the reference wall 70*b* in a direction orthogonal to the surface of the paper abutting to the abutting surface. And the first wall 70*a* extends upstream in the paper conveying direction so as to be level with the upper surface (a load surface) 37*a*. The second wall 70*c* extends toward the upstream side in the paper conveying direction from the other end of the reference wall 70*b* in the orthogonal direction. In this case, a line-shaped reference position extending in a width direction orthogonal to the paper conveying direction is defined by the surface position of the reference wall 70*b* on the upstream side in the paper conveying direction.

Three sets of the first wall 70*a*, the reference wall 70*b*, and the second wall 70*c* are formed away from the processing positions at which the stapling (a paper process) is to be performed by the stapler 60 and which are defined as some of the aforementioned reference positions. The three positions at each of which one of the three sets of the first wall 70*a*, the reference wall 70*b*, and the second wall 70*c* is formed constitute paper receiving positions C1, C2, and C3. The paper receiving positions C1, C2, and C3 are each set as standby positions of the stapler 60. Hereinafter, the paper receiving positions C1, C2, and C3 are collectively referred to as a paper receiving position C.

Further, the first wall 70*a*, the reference wall 70*b*, and the second wall 70*c* may be integrated into one and the paper receiving position may be one.

Further, a biasing film 74 (a biasing member) extending in a direction inclined toward the first wall 70*a* is attached to the reception wall 70*d*, at the paper receiving position. The biasing film 74 is fixed to an upper surface side of the reception wall 70*d*, and disposed to extend in a direction of the first wall 70*a* through an opening part formed on the second wall 70*c*.

The biasing film 74 is a plate-shaped member with elasticity. The biasing film 74 biases the paper P received by the catching member 70 to a direction of the first wall 70*a* to elastically press the first wall 70*a*.

As the processing position, processing positions B1 and B2 for executing corner binding (inclined binding) for performing the stapling process on the bundle of paper are formed in the vicinity of a corner portion (a corner) of the bundle of paper and processing positions B3 and B4 for executing two point binding for performing the staple process at two places are formed in the vicinity of a tip of the bundle of paper. Hereinafter, the processing positions B1, B2, B3, and B4 are collectively referred to as a processing position B.

A conveying roller 72 rotating around a shaft extending in a width direction is arranged at the end portion of the lower tray 372 on the upstream side in the paper conveying direction. Further, a pair of width direction paper cursors 73 defining the position of the paper P in the width direction are attached to the upper surface of the lower tray 372.

Thus, the paper P conveyed from the pair of introduction rollers 424 to the staple tray 37 is received in the upper tray 371 and reaches the conveying roller 72 of the lower tray 372 while sliding on the upper surface 37*a* of the upper tray 371. When the paper P reached on the conveying roller 72 is conveyed by the rotation of the conveying roller 72 and the tip of the paper P abuts the reference wall 70*b*, that is, the tip of the paper P is received by the catching member 70 at a reference position, the paper P is stored in the storage space V1.

Thus, the bundle of paper is formed on the staple tray 37 and stored in the storage space V1 by repeating the conveying of the paper P from the pair of introduction rollers 424 to the staple tray 37. The tip part of the bundle of paper stored in the storage space V1 is inserted into a U-shaped space formed by the first wall 70*a*, the reference wall 70*b*, and the second wall 70*c*. Further, the tip part of the bundle of paper is inserted by the first wall 70*a* and the second wall 70*c* at a position at which the tip part of the bundle of paper is inserted into the U-shaped space. As a result, both sides of the bundle of paper are in a state covered with the first wall 70*a* and the second wall 70*c*.

Meanwhile, since the first wall 70*a*, the reference wall 70*b*, and the second wall 70*c* are not formed at the processing position B, the tip part of the bundle of paper is held by the catching member 70 in an exposed state, without being covered with the first wall 70*a* and the second wall 70*c*.

The stapler 60 includes a cradle 61 (a first protruding part) receiving the bundle of paper to be processed and an arm part 62 (a second protruding part) which are disposed opposite each other at an interval from the cradle 61. The arm part 62 is swingable by the driving mechanism (not illustrated). Further, when the bundle of paper is inserted between the cradle 61 and the arm part 62, the arm part 62 is driven and the bundle of paper is sandwiched by the cradle 61 and the arm part 62.

The stapler 60 includes an embedded staple mechanism which punches out the staple from the cradle 61 toward the arm part 62. The stapler 60 punches out the staple from the cradle 61 toward the arm part 62 in the state in which the bundle of paper is sandwiched between the cradle 61 and the arm part 62 to penetrate the staple through the bundle of paper. The arm part 62 folds the front end of the staple protruding from the bundle of paper to perform the stapling process on the bundle of paper. A groove for punching out the staple is formed on the surface of the cradle 61.

The stapler 60 is slidably mounted on a stapler base 38 in a width direction of the paper P.

The stapler base 38 is a substantially rectangular plate-shaped member which has a long side in a width direction. The stapler base 38 is provided with a guide slit 381 extending in the width direction. The guide slit 381 has two guide holes 3811 and 3812. Further, the stapler base 38 includes a moving mechanism 380 which is disposed to move the stapler 60 along the guide slit 381.

The moving mechanism 380 includes a driving motor 383 and an endless belt 382. The driving motor 383 is configured to supply a driving force for moving the stapler 60 along the guide slit 381. A lower portion of the driving motor 383 is inserted in a penetrating hole formed in the stapler base 38. An output shaft is provided in a lower surface of the driving motor 383 to transfer a rotary driving force of the driving motor 383. The output shaft extends downward from the lower surface of the driving motor 383 and is disposed on a back side of (under) the stapler base 38 in FIG. 3.

In addition, a shaft extending downward from the back side of the stapler base 38 is disposed on a near position of an end part 3812*a* of the guide hole 3812 and on the back side portion of the stapler base 38 which is an end part side thereof in the length direction. A pulley is mounted on the shaft.

The belt 382 is viewed through the guide hole 3812 in FIG. 3. The belt 382 is tightly stretched between the output shaft and the pulley along the guide hole 3812. If the output shaft rotates by the rotary driving force of the driving motor 383, the belt 382 runs while the pulley is driven and rotated.

An engaging part is provided under the stapler 60. The engaging part, for example, penetrates the guide hole 3812 and extends downward on the back side of the stapler base 38. Further, a protruding part which is inserted into the guide hole 3811 and extends downward is also provided under the stapler base 38. In addition, the engaging part of the stapler base 38 is engaged with the belt 382 tightly stretched between the output shaft and the pulley on an inner surface of the belt 382. Thus, if the output shaft rotates by the rotary driving force of the driving motor 383 and the belt 382 runs, the stapler 60 is guided along the guide holes 3811 and 3812 and slidably moves in the width direction following running of the belt 382 by the engagement of the guide hole 3811 and the protruding part, and the engagement of the guide hole 3812 and the engaging part. In addition, the stapler 60 is movable in both right and left directions in FIG. 3 along the guide holes 3811 and 3812 by the rotating direction change of the output shaft by the driving motor 383.

Inclined guide parts 381*a* inclined toward the upstream side in the paper conveying direction are disposed at both end portions of the guide slit 381. Thus, when the belt 382 runs by the driving motor 383 and the stapler 60 moves to a position at which the stapler 60 is engaged with the inclined guide parts 381*a*, the stapler 60 is changed in position along the inclination of the inclined guide part 381*a* such that the stapler 60 has an obliquely inclined position with respect to the paper conveying direction. As such, the stapler 60 may perform the stapling process of the inclined binding with respect to the bundle of paper by being obliquely inclined position with respect to the paper conveying direction.

When the stapler 60 is positioned at the processing position B by the driving force of the driving motor 383 as described above, the end portion of the bundle of paper held by the catching member 70 is received between the cradle 61 and the arm part 62. Thus, the stapler 60 may perform the stapling process on the end portion of the bundle of paper received between the cradle 61 and the arm part 62.

Meanwhile, when the stapler 60 is positioned at the paper receiving position C (the standby position) by the driving force of the driving motor 383, as illustrated in FIG. 4, the first wall 70*a*, the reference wall 70*b*, and the second wall 70*c* are received between the cradle 61 and the arm part 62. In this case, since the bundle of paper is received between the cradle 61 and the arm part 62 in the state in which the bundle of paper is covered with the first wall 70*a* and the second wall 70*c*, the paper P does not contact the cradle 61 and the arm part 62.

Figure 5:
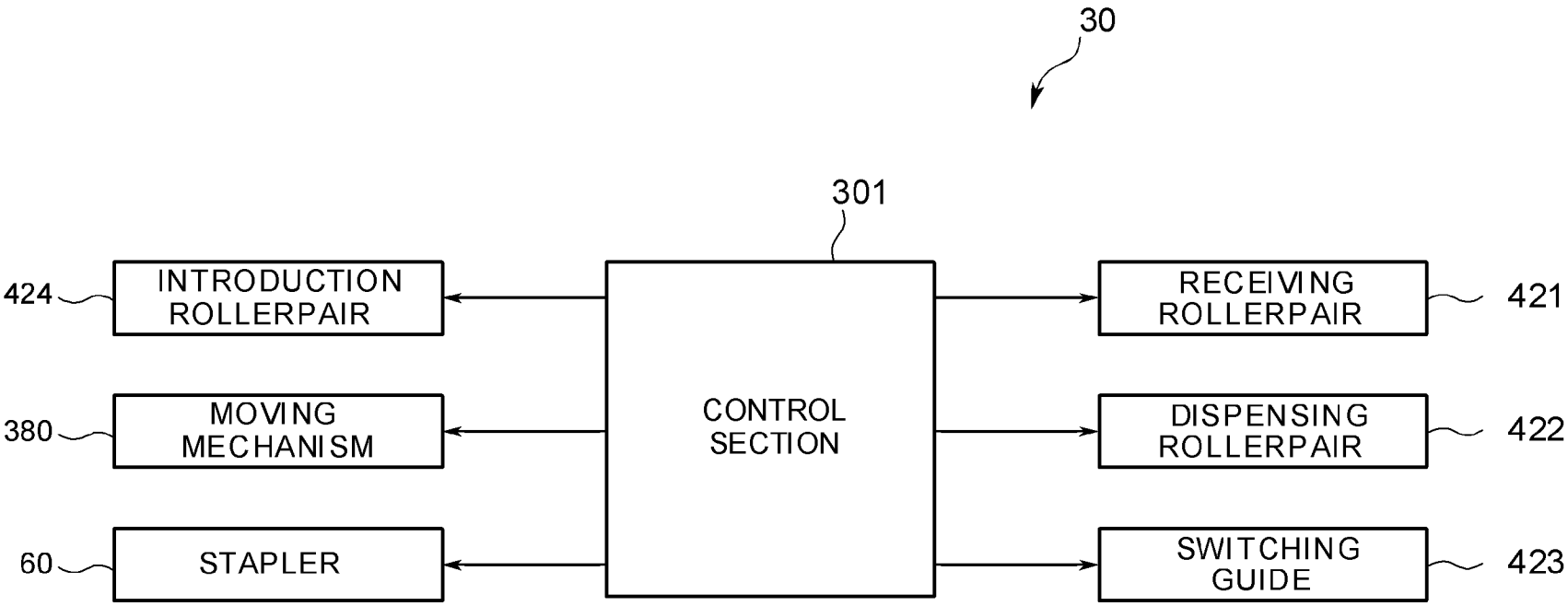
FIG. 5 is a block diagram illustrating an example of an electrical configuration of the paper processing apparatus illustrated in FIG. 2.

FIG. 5 is a block diagram illustrating an example of an electrical configuration of the paper processing apparatus 30. The paper processing apparatus 30 illustrated in FIG. 5 includes, for example, a central processing unit (CPU) which performs predetermined operation processes, a read only memory (ROM) in which a predetermined control program is stored, a random access memory (RAM) which temporarily stores data, and a control section 301 including a periphery circuit thereof, and the like.

The control section 301 executes the control program stored in, for example, the ROM to control the operations of the pair of receiving rollers 421, the pair of dispensing rollers 422, the switching guide 423, the pair of introduction rollers 424, the moving mechanism 380, and the stapler 60.

The control section 301 controls the operations of a motor or actuator (not illustrated) which drive the pair of receiving roller 421, the pair of dispensing rollers 422, the switching guide 423, and the pair of introduction rollers 424 to control the operations of the pair of receiving rollers 421, the pair of dispensing rollers 422, the switching guide 423, and the pair of introduction rollers 424. Further, the control section 301 controls the operation of the moving mechanism 380 to move the stapler 60 to a desired position. Further, the control section 301 transmits a predetermined control signal to the stapler 60 to cause the stapler 60 to perform a stapling process.

Figure 6:
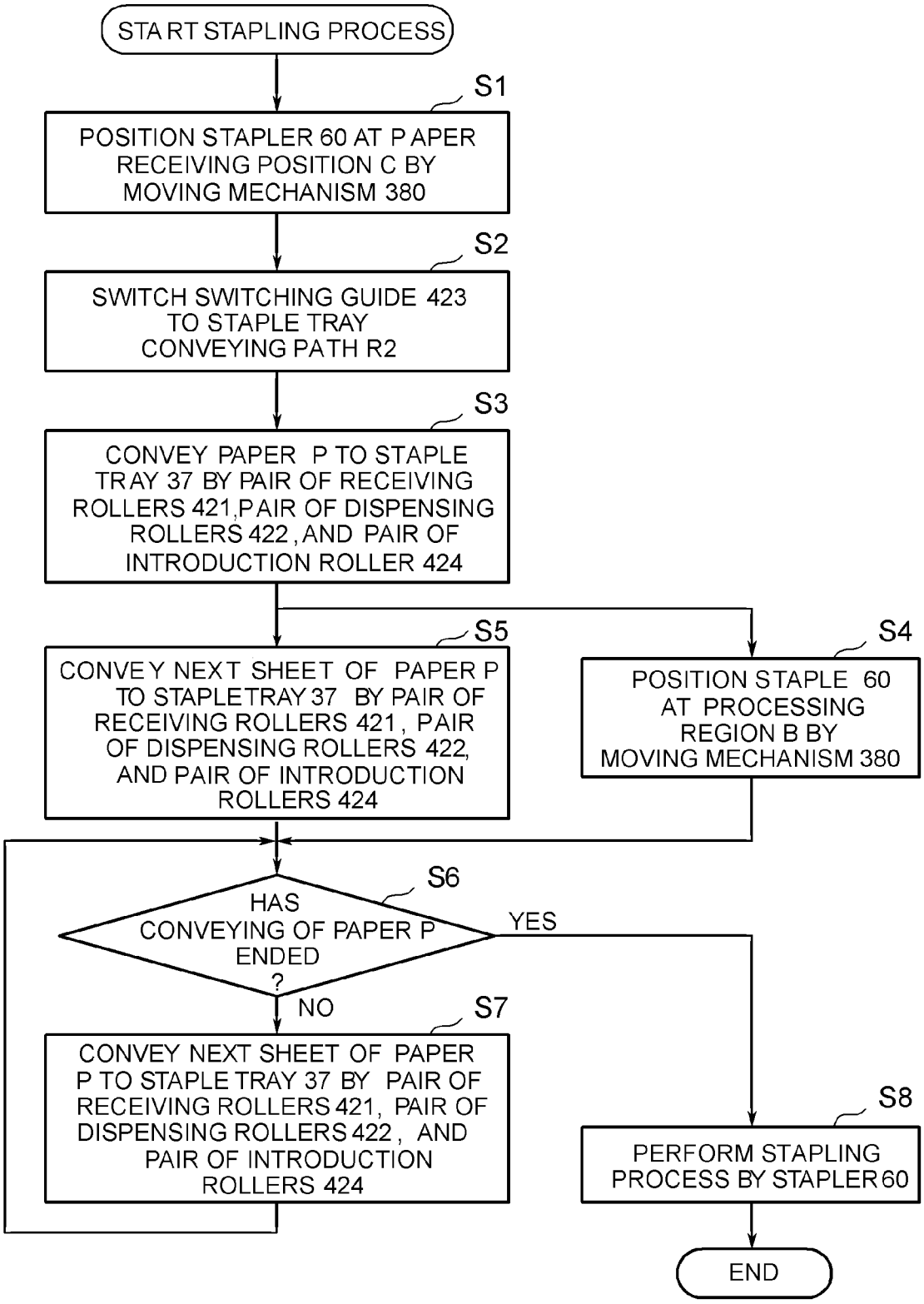
FIG. 6 is a flow chart illustrating an example of an operation of the paper processing apparatus when a stapling process is performed.

FIG. 6 is a flow chart illustrating an example of an operation of the paper processing apparatus 30 when the stapling process is performed. When the stapling process is performed, At first the control section 301 positions the stapler 60 at the paper receiving position C by the moving mechanism 380 (step S1). The paper receiving position C at which the stapler 60 is positioned may be any one of the paper receiving positions C1, C2, and C3.

Next, the control section 301 switches the switching guide 423 to the staple tray conveying path R2 (step S2). Thus, the paper P can be conveyed to the staple tray 37.

Next, the control section 301 conveys the paper P conveyed toward the paper receiving opening 32 from the apparatus main body section 20 to the staple tray 37 by the pair of receiving rollers 421, the pair of dispensing rollers 422, and the pair of introduction rollers 424 while the stapler 60 waits at the paper receiving position C (step S3).

Thus, the paper P is conveyed onto the staple tray 37, and the tip of the paper P is received by the three reference walls 70*b* to store the paper P on the staple tray 37. In this case, the tip of the paper P is biased to the first wall 70*a* by the biasing film 74 to be elastically pressed. When the tip of the paper P is biased to the first wall 70*a* by the biasing film 74, the paper P or the tip of the bundle of paper is biased to the cradle 61 of the stapler 60 when the stapler 60 is positioned at the processing position B. Thus, the tip of the bundle of paper to be subjected to the stapling process can be pressed to the cradle 61 of the stapler 60 to match the tip part of the paper P. As a result, the stapling process result may be better at the tip part of the bundle of paper than when the stapling process is performed while the tip part of the bundle of paper is dispersed without being pressed to the cradle 61, without including the biasing film 74.

Figure 7:
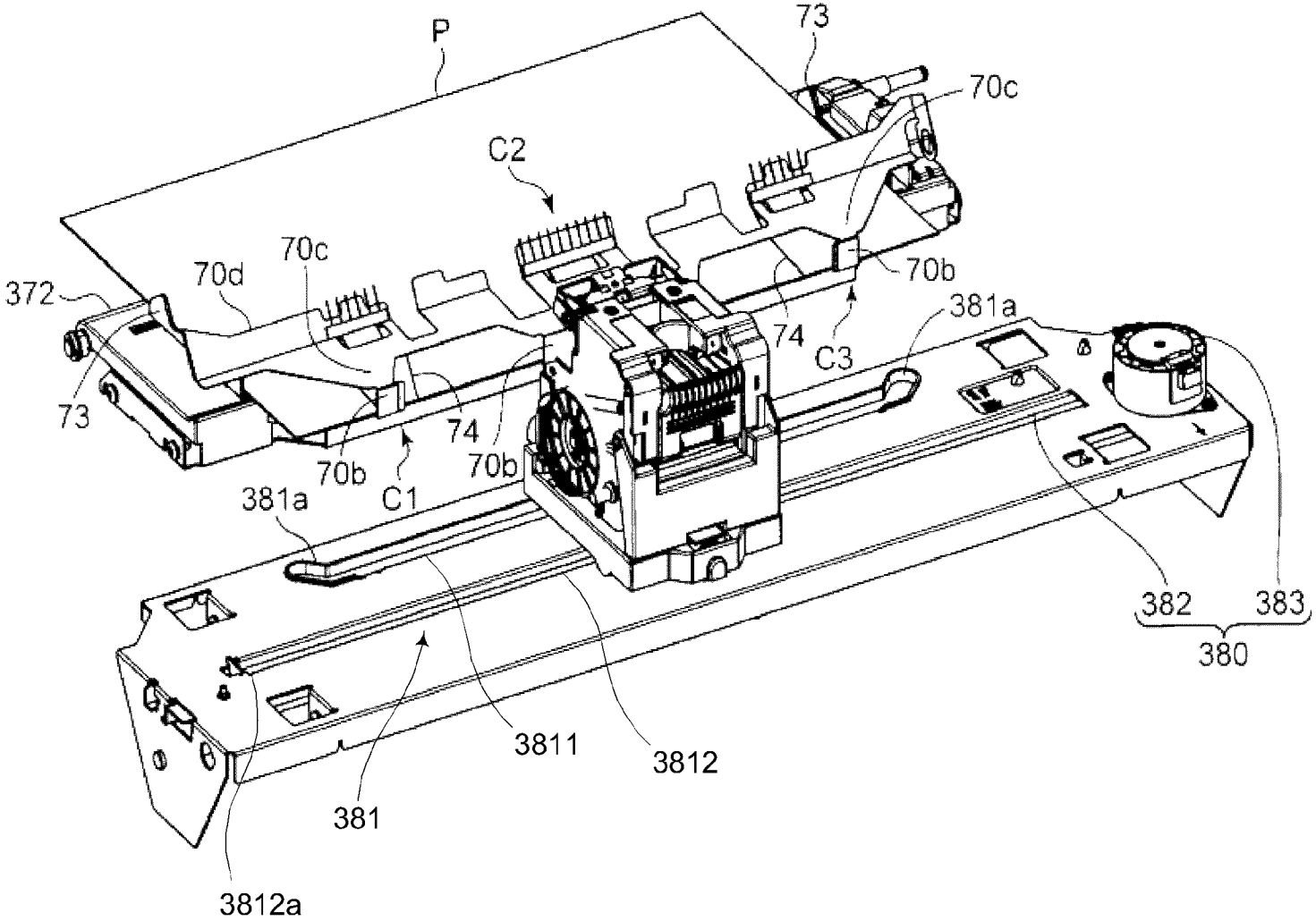
FIG. 7 is a diagram for describing a state in which paper is received by a reference wall while a stapler is positioned at a paper receiving position.

By the processing in step S3, when the paper P is conveyed into the staple tray 37 such that the tip of the paper P is received by the reference wall 70*b*, the stapler 60 is positioned at the paper receiving position C. FIG. 7 illustrates a state in which the paper P is received by the reference wall 70*b* after the stapler 60 is positioned at the paper receiving position C2. When the stapler 60 is positioned at the paper receiving position C, the second wall 70*c* is between the arm part 62 and the paper P and the first wall 70*a* is between the cradle 61 and the paper P.

When the paper P is conveyed by the pair of introduction rollers 424, and the like, while the stapler 60 is positioned at the processing position B without performing step S1, the tip part of the paper P corresponding to the processing position B enters between the cradle 61 and the arm part 62 of the stapler 60 in an exposed state. Grooves or other irregularities are formed on an upper surface of the cradle 61 for punching out the staple. A mechanism receiving the tip of the staple penetrating the paper P and performing the fastening process is formed on a lower surface of the arm part 62. To this end, irregularities are formed on the lower surface of the arm part 62.

The tip of the paper P is biased to the first wall 70*a* by the biasing film 74 and thus the tip of the paper P is biased to the cradle 61 at the processing position B. For this reason, when the tip of the paper P enters between the cradle 61 and the arm part 62 in the exposed state, the tip of the paper P may interfere with (jam) the cradle 61. Alternatively, in the case of a configuration in which the biasing film 74 is not provided, the tip of the paper P may interfere with (jam) the arm part 62.

When the tip of the paper P jams the cradle 61 or the arm part 62, the paper P is not accurately positioned at a reference position, the mismatch of the bundle of paper occurs, or the binding defect of the stapling process occurs.

In particular, to perform the inclined binding, as illustrated in FIG. 3, the groove on the upper surface of the cradle 61 is inclined with respect to the paper conveying direction by making the stapler 60 wait at the processing position B in the obliquely inclined state. For this reason, the jamming of paper may more easily occur, compared to the case in which the stapler 60 is not inclined. Further, in the case of the inclined binding, since the corner portion of the paper P enters the cradle 61, the jamming of the paper P may more easily occur.

However, the paper processing apparatus 30 performs step S1 and positions the stapler 60 at the paper receiving position C. In this state, the paper processing apparatus 30 conveys the paper P to the staple tray 37 by the pair of introduction rollers 424, and the like, in step S3. As described above, the first wall 70*a*, the reference wall 70*b*, and the second wall 70*c* are received between the cradle 61 and the arm part 62 while the stapler 60 is positioned at the paper receiving position C. Therefore, the paper P is received between the cradle 61 and the arm part 62 in the state in which the paper P is covered with the first wall 70*a* and the second wall 70*c*. Therefore, the paper P does not contact the cradle 61 and the arm part 62 and the tip of the paper P does not jam the cradle 61.

Further, the stapler 60 can be positioned at the paper receiving position C in step S1 using the moving mechanism 380 provided to move the stapler 60 to the processing positions B1, B2, B3, and B4. Therefore, no new mechanism is required to perform the processing of conveying the paper P to the staple tray 37 while the stapler 60 is positioned at the paper receiving position C. Therefore, for example, as in the background art, the paper processing section does not need the film member to reduce the interference of paper, and thus costs to reduce the interference of paper of the paper processing section may be decreased. Further, in the process of manufacturing the paper processing apparatus 10, the installation operation of the film member is unnecessary, and thus the manufacturing costs of the corresponding operation are not increased.

Next, the control section 301 controls the moving mechanism 380 to move the stapler 60 to the processing position B (step S4). For example, when the inclined binding is performed as the stapling process, the control section 301 controls the stapler 60 to move to the vicinity of the end portion in a width direction of the paper P. In this case, the stapler 60 is pivoted along the inclination of the inclined guide part 381*a* to have an obliquely inclined position with respect to the paper conveying direction. Thus, the stapler 60 may perform the so-called inclined binding and obliquely fasten the staple in the vicinity of the corner portion of the paper P.

Further, the control section 301 causes the pair of receiving rollers 421, the pair of dispensing rollers 422, and the pair of introduction rollers 424 to convey a next sheet of paper P conveyed toward the paper receiving opening 32 from the apparatus main body section 20 to the staple tray 37 (step S25), together with step S4.

As such, by performing steps S4 and S5 in parallel, that is, while the paper P is stored in the staple tray 37, a new sheet of paper is conveyed to the staple tray 37 by the pair of introduction rollers 424, and the like, while the stapler 60 moves to the processing position B by the moving mechanism 380. In this case, the stapler 60 can be moved to the processing position B during the conveying of the paper P after a second sheet, thereby all the paper P to be subjected to the stapling process is stored in the staple tray 37 and the processing ends. Therefore, the execution time of the stapling process can be shortened, compared to the case in which the bundle of paper is formed and then the stapler 60 moves to the processing position B.

Further, when the stapler 60 moves to the processing position B during the conveying of the paper P after a second sheet, the first sheet of paper P is stored in the staple tray 37 in advance and thus the tip part of the first sheet of paper P is biased to the cradle 61 by the biasing film 74. Therefore, when the stapler 60 moves to the processing position B, the cradle 61 is covered with the first sheet of paper P. Further, since all the paper P after the first sheet is biased to the cradle 61 by the biasing film 74, all the paper P after the first sheet does not jam the irregularities on the lower surface of the arm part 62.

Therefore, even when steps S4 and S5 are performed in parallel, the paper P does not jam the cradle 61 or the arm part 62.

Next, the control section 301 confirms whether all the paper P to be subjected to the stapling process has been conveyed into the staple tray 37 (step S6). The control section 301 receives a signal indicating that all the paper P to be subjected to the staple process is conveyed toward the paper processing apparatus 30 from, for example, the above-mentioned main body control section, and when there is no paper P conveyed by the pair of receiving roller 421, the pair of dispensing roller 422, and the pair of introduction roller 424, determines that the conveying to the staple tray 37 has ended.

Further, when at least a portion of the paper P to be subjected to the stapling process has not been conveyed to the staple tray 37 (NO in step S6), the control section 301 proceeds to step 7 to convey a next sheet of paper P toward the paper receiving opening 32 from the apparatus main body section 20 to the staple tray 37 by the pair of receiving rollers 421, the pair of dispensing rollers 422, and the pair of introduction rollers 424 (step S7) and again proceeds to step S6.

Meanwhile, when all the paper P to be subjected to the stapling process has been conveyed to the staple tray 37 (YES in step S6), the bundle of paper to be subjected to the staple process is formed on the staple tray 37. Then, the control section 301 controls the stapler 60 to perform the staple process on the bundle of paper on the staple tray 37 (step S8) and ends the processing.

Further, the biasing film 74 may not necessarily be provided. The first sheet of paper P is conveyed to the staple tray in steps S1 and S3 without the biasing film 74 and after the tip of the paper P is received by the reference wall 70*b*, one of the cradle 61 and the arm part 62 is covered with the first sheet of paper P. Therefore, when steps S4 and S5 are processed in parallel, the potential of interference between the paper P and the cradle 61 and the arm part 62 is likely to be reduced.

Further, the embodiment of the present invention is not necessarily limited to the example of processing steps S4 and S5 in parallel. For example, after the conveying of the paper P ends (YES in step S6), step S4 may be performed prior to performing step S8. Even in this case, an effect of decreasing costs to reduce the interference of the paper processing section can be obtained.

Further, it is not necessary to form the plurality of first walls 70*a*, reference walls 70*b*, and second walls 70*c*, that is, the plurality of paper receiving positions C. It is sufficient to form a set of first walls 70*a*, reference walls 70*b*, and second walls 70*c* and one paper receiving position C. Further, the present invention is not limited to an example of forming the plurality of processing positions B. It is sufficient to form one processing position B.

Further, the example in which, in step S3, the first sheet of paper P is conveyed to the staple tray 37, and then in step S4, the stapler 60 moves to the processing position B is illustrated. However, after conveying at least the first sheet of paper P to the staple tray 37 and before conveying all the paper P to be processed to the staple tray 37, it is sufficient to move the stapler 60 to the processing position B. For example, after the paper P after the first sheet is conveyed to the staple tray 37, the stapler 60 may move to the processing position B.

Further, even though the stapler 60 is illustrated as the paper processing section, the paper processing section is not necessarily the stapler. For example, as the paper processing section, a punch apparatus performing the punching processing may be used.

Further, the paper processing section does not necessarily include the first and second protruding parts. For example, only one of the first and second protruding parts may be provided. When the paper processing section includes only the first protruding part of the first and second protruding parts, the catching member 70 need not include the second wall 70*c*. When the paper processing section includes only the second protruding part of the first and second protruding parts, the catching member 70 need not include the first wall 70*a*.

Further, even though the embodiment describes the paper processing apparatus 30 as one component of the image forming apparatus 10, the paper processing apparatus 30 may not be one component of the image forming apparatus 1 but may be used as a combination of various apparatuses which handle paper, such as a general printing machine, a sorting machine, and a bookbinding machine.

Further, a copying machine capable of performing color printing is used as the apparatus main body section 20 which is a component of the image forming apparatus 10. The image forming apparatus is not limited to one for the copying machine. A printer and a facsimile machine may be used as the image forming apparatus. Further, the image forming apparatus is not limited to one for color printing and an image forming apparatus for monochrome printing may be used.

Various modifications and alterations of this disclosure will be apparent to those skilled in the art without departing from the scope and spirit of this disclosure, and it should be understood that this disclosure is not limited to the illustrative embodiments set forth herein.

What is claimed is:

1. A paper processing apparatus, comprising:

a tray having a load surface on which paper is loaded and stored;

a conveying section configured to convey the paper to the tray;

a catching member which includes an abutting surface which abuts a tip part of the paper in a conveying direction of the paper conveyed by the conveying section and is disposed on the load surface, and a covering part which is disposed on the abutting surface to cover at least one of one surface and the other surface of the paper in a state in which the tip part abuts the abutting surface, wherein the abutting surface and the covering part are disposed in a partial region in a paper width direction orthogonal to the conveying direction at a position on a downstream side in the conveying direction in the tray;

a paper processing section including a processing region which receives the tip part of the paper in the abutting state to perform a predetermined paper process on the tip part;

a moving mechanism configured to move the paper processing section in the paper width direction; and a control section configured to control the moving mechanism to move the paper processing section between a standby position at which the catching member is received positioned in the processing region and a processing position at which the catching member is not positioned in the processing wherein the control section controls the conveying unit to convey the paper to the tray in a state in which the moving mechanism positions the paper processing section at the standby position, wherein the catching member comprises:

a reference wall having the abutting surface and configured to extend in a direction orthogonal to the paper surface of the paper;

a first covering part configured to extend so as to be level with the load surface toward an upstream side in the conveying direction from one end of the reference wall in the orthogonal direction; and a second covering part configured to extend toward the upstream side in the conveying direction from the other end of the reference wall in the orthogonal direction and wherein the paper processing section comprises:

a first protruding part configured protrude upstream in the conveying direction than the abutting surface at the load surface side than the paper received by the abutting surface; and a second protruding part configured to protrude upstream in the conveying direction than the abutting surface to insert the tip part of the paper between the second protruding part and the first protruding part at an opposite side to the load surface than the paper received by the abutting surface, wherein the paper processing section receives the paper between the first protruding part and the second protruding part in a state in which the paper processing section is at the processing position and performs the paper process on the paper without through the first covering part and the second covering part, and receives at least a part of the first covering part and the second covering part between the first protruding part and the second protruding part in a state in which the paper processing section is at the standby position.

2. The paper processing apparatus of claim 1, wherein the catching member is disposed in plural, and the control section sets each position at which each of the catching members is positioned in the processing region as the standby position and controls the conveying section to convey the paper to the tray in a state in which the moving mechanism positions the paper processing section at any one of the standby positions.

3. The paper processing apparatus of claim 1, wherein the control section performs the processes of:

allowing the moving mechanism to position the paper processing section at the standby position;

allowing the conveying section to convey the paper to the tray in a state in which the paper processing section is positioned at the standby position to store the paper in the tray; and allowing the moving mechanism to move the paper processing section to the processing position in a state in which the paper is stored in the tray.

4. The paper processing apparatus of claim 3, wherein the control section controls the conveying section to convey a new sheet of paper to the tray while moving the paper processing section to the processing position in the state in which the paper is stored in the tray, during the moving process.

5. The paper processing apparatus of claim 3, further comprising:

a biasing member configured to bias a vicinity of the tip part of the paper received by the reference wall toward the load surface side.

6. The paper processing apparatus of claim 1, wherein the paper process is a stapling process.

7. An image forming apparatus, comprising:

the paper processing apparatus according to claim 1; and an image forming section configured to form an image on the paper, wherein the conveying section conveys the paper on which the image is formed by the image forming section to the tray.

8. A paper processing apparatus, comprising:

a tray having a load surface on which paper is loaded and stored;

a conveying section configured to convey the paper to the tray;

a catching member which includes an abutting surface which abuts a tip part of the paper in a conveying direction of the paper conveyed by the conveying section and is disposed on the load surface, and a covering part which is disposed on the abutting surface to cover at least one of one surface and the other surface of the paper in a state in which the tip part abuts the abutting surface, wherein the abutting surface and the covering part are disposed in a partial region in a paper width direction orthogonal to the conveying direction at a position on a downstream side in the conveying direction in the tray;

a paper processing section including a processing region which receives the tip part of the paper in the abutting state to perform a predetermined paper process on the tip part;

a moving mechanism configured to move the paper processing section in the paper width direction; and a control section configured to control the moving mechanism to move the paper processing section between a standby position at which the catching member is positioned in the processing region and a processing position at which the catching member is not positioned in the processing region, wherein the control section controls the conveying unit to convey the paper to the tray in a state in which the moving mechanism positions the paper processing section at the standby position, wherein the catching member is disposed in plural, and wherein the control section sets each position at which each of the catching members is positioned in the processing region as the standby position and controls the conveying section to convey the paper to the tray in a state in which the moving mechanism positions the paper processing section at any one of the standby positions.

* * * * *